US008382103B2

(12) United States Patent
Cong et al.

(10) Patent No.: US 8,382,103 B2
(45) Date of Patent: Feb. 26, 2013

(54) SHEET MEDIUM PROCESSING DEVICE

(75) Inventors: Qiangzi Cong, Shandong (CN); Ming Gao, Shandong (CN); Tao Gao, Shandong (CN); Tianxin Jiang, Shandong (CN); Kai Liu, Shandong (CN)

(73) Assignee: Shangdong New Beiyang Information Technology Co., Ltd., Weihai (CN)

( * ) Notice: Subject to any disclaimer, the term of this patent is extended or adjusted under 35 U.S.C. 154(b) by 0 days.

(21) Appl. No.: 13/148,927

(22) PCT Filed: Feb. 9, 2010

(86) PCT No.: PCT/CN2010/070591

§ 371 (c)(1),
(2), (4) Date: Aug. 10, 2011

(87) PCT Pub. No.: WO2010/091633

PCT Pub. Date: Aug. 19, 2010

(65) Prior Publication Data

US 2011/0309565 A1 Dec. 22, 2011

(30) Foreign Application Priority Data

Feb. 13, 2009 (CN) ..... 2009 1 0008948

(51) Int. Cl.
*B65H 9/04* (2006.01)

(52) U.S. Cl. ..... 271/245; 271/273; 271/198

(58) Field of Classification Search ..... 271/3.14, 271/3.19, 3.21, 4.1, 225, 243, 245, 273, 189, 271/191, 198

See application file for complete search history.

(56) References Cited

U.S. PATENT DOCUMENTS

| | | | | |
|---|---|---|---|---|
| 4,747,493 | A * | 5/1988 | Nakanishi | 209/534 |
| 5,106,077 | A * | 4/1992 | Kawaguchi et al. | 271/302 |
| 5,330,316 | A * | 7/1994 | Buckman et al. | 414/790.2 |

FOREIGN PATENT DOCUMENTS

| | | |
|---|---|---|
| CN | 1876537 | 12/2006 |
| CN | 101249910 | 8/2008 |
| CN | 201362521 | 12/2009 |
| JP | 03148791 | 6/1991 |
| JP | 06274739 | 9/1994 |

OTHER PUBLICATIONS

International Search Report from corresponding PCT Application No. PCT/CN2010/070591, mailed May 13, 2010, 6 pages.

* cited by examiner

*Primary Examiner* — Michael McCullough
(74) *Attorney, Agent, or Firm* — Shumaker & Sieffert, P.A.

(57) ABSTRACT

A sheet medium processing device comprises a housing, a feeding mechanism (1) mounted on the housing, a stacking mechanism (2) and a switching mechanism (3). The stacking mechanism (2), which is located downstream of the feeding mechanism (1), comprises an upper channel (20), a lower channel (21) and a channel driving mechanism (22). The lower channel is fixedly connected with the housing, and the upper channel is hinged with the housing with one end thereof separatable from or contactable with the lower channel. The channel driving mechanism is used to drive the upper and lower channels to move synchronously to transport sheet mediums. The switching mechanism (3) comprises a first cam (30) and a cam driving mechanism (31), wherein the cam is joined with the upper channel to drive the upper channel to rotate. Different transporting directions are formed by adjusting the position relationship between the upper channel and the lower channel of the stacking mechanism using the switching mechanism and thus sheet mediums are transported to different destinations according to specific requirements.

9 Claims, 6 Drawing Sheets

SHEET MEDIUM PROCESSING DEVICE

TECHNICAL FIELD OF THE INVENTION

The present invention relates to a sheet medium processing device.

BACKGROUND OF THE INVENTION

Familiar sheet mediums include train tickets, airplane tickets, checks, cashes and the like. With the popularization of self-services, the automatic processing, such as stacking, distributing and withdrawing sheet mediums, is demanded in more and more industries and fields. For example, cash outputting mechanisms are used in the financial field to stack, convey and withdraw cashes, and ticket issuing devices are used in the railway filed to stack, convey and withdraw ticket sheets. Conventional sheet medium processing devices have the disadvantages of complex structure with numerous components and high cost. In order to address the problem above, a sheet medium processing device is disclosed in the Chinese Patent Application No. 200810027225.0, which comprises a housing; a feeding channel mounted on the housing; a hub assembly mounted on the housing and located at the outlet of the feeding channel for conveying sheet mediums to the hub assembly in a stacking and packing assembly; the stacking and packing assembly comprising a supporting plate for stacking a sheet medium received, limit lateral plates arranged at two sides of the support plate for aligning the sheet medium and a unidirectionally-rotating baffle plate arranged in a sheet medium transporting path; and a conveying component connected with the support plate for driving the support plate to convey the sheet mediums therefrom. The solution above mentioned has the following disadvantages: sheet mediums, if curved, may form an irregular alignment in the vertical direction after being stacked since no pressing device is provided above the support plate, and as a result, a blocking may easily occur at the output position when the support plate carries the sheet mediums out from the device. Therefore, such sheet medium processing device requires higher flatness of the mediums and is difficult to be applied on various types of mediums.

SUMMARY OF THE INVENTION

In view of the above, an object of the embodiments of the present invention is to provide a simply-structured sheet medium processing device with great adaptability for various mediums.

In order to achieve the object above mentioned, the embodiments according to the present invention provide a technical solution as follows:

a sheet medium processing device comprises a housing and a feeding mechanism mounted on the housing, the feeding mechanism comprises a driving feeding roller and a driven feeding roller, and the device further comprises:

a stacking mechanism, which is located downstream of the feeding mechanism and comprises an upper channel, a lower channel and a channel driving mechanism, wherein the lower channel is fixedly connected with the housing, the upper channel is hinged with the housing with one end thereof separatable from or contactable with the lower channel, and the channel driving mechanism is connected with the upper channel and the lower channel to drive the upper channel and the lower channel to move synchronously so as to transport sheet mediums; and a switching mechanism comprising a first cam and a cam driving mechanism, wherein the first cam is joined with the upper channel for driving the upper channel to rotate.

The upper channel comprises an upper channel support, a first pulley set, a first belt and a support rotating shaft, wherein the first pulley set is supported by the upper channel support, the first belt is supported by the first pulley set, and the upper channel support is hinged with the housing via the support rotating shaft.

The lower channel comprises a second pulley set supported by the housing and a second belt supported by the second pulley set.

One end of the first belt can be separated from or contacted with the second belt when the upper channel support rotates around the support rotating shaft.

The above device further comprises an aligning mechanism, which comprises an aligning support plate, a second cam and a first elastic element, wherein the aligning support plate is hinged with the housing, the second cam is fixedly connected with the rotating shaft of the first cam and joined with the aligning support plate; and the first elastic element is at one end connected with the aligning support plate and at the other end connected with the housing.

The upper channel further comprises a second elastic element, and the second elastic element is at one end connected with the housing and at the other end connected with the upper channel support.

The end of the first belt away from the feeding mechanism is always contacted with the second belt.

A withdrawing box is arranged downstream of the stacking mechanism.

The feeding mechanism further comprises a first channel plate, a second channel plate, a floating plate and a third elastic element, wherein the floating plate is hinged with the housing and located between the first channel plate and the second channel plate; and the third elastic element is at one end connected with the housing and at the other end connected with the floating plate, and the floating plate is contacted with the first channel plate when being pulled by the third elastic element.

An invalidated ticket box is arranged between the feeding mechanism and the stacking mechanism.

The first pulley set comprises a first pulley, a second pulley and a third pulley, and the third pulley is located between the first pulley and the second pulley to support the first belt to be always contacted with the second belt.

The third pulley is mounted over the support rotating shaft.

By adjusting the position relationship between the upper channel and the lower channel of the stacking mechanism using the switching mechanism, the embodiments of the present invention realize the alignment, stacking and transportation of sheet mediums. A space for accommodating sheet mediums is formed between the upper channel and the lower channel when the upper channel is separated from the lower channel at one end, and a sheet medium transporting path is formed when the upper channel is contacted with the lower channel at the external surface. During the conveying process, the stacked plural sheet mediums are vertically trimmed and limited by means of the elasticity of the belts of the upper channel and the lower channel and thus sheet mediums, even curved, can be conveyed reliably and the adaptability of the device for mediums is improved. Additionally, by adjusting the position relationship between the upper channel and the lower channel of the stacking mechanism using the switching mechanism, different transporting directions can be formed so as to transport sheet mediums to different destinations according to specific requirements.

DETAILED DESCRIPTION OF THE EMBODIMENTS

The present invention will be described below with reference to the accompanying figures, and the following description is only illustrative and explanatory and is not construed as limitation to the protection scope of the present invention.

Embodiment 1

Figure 1:
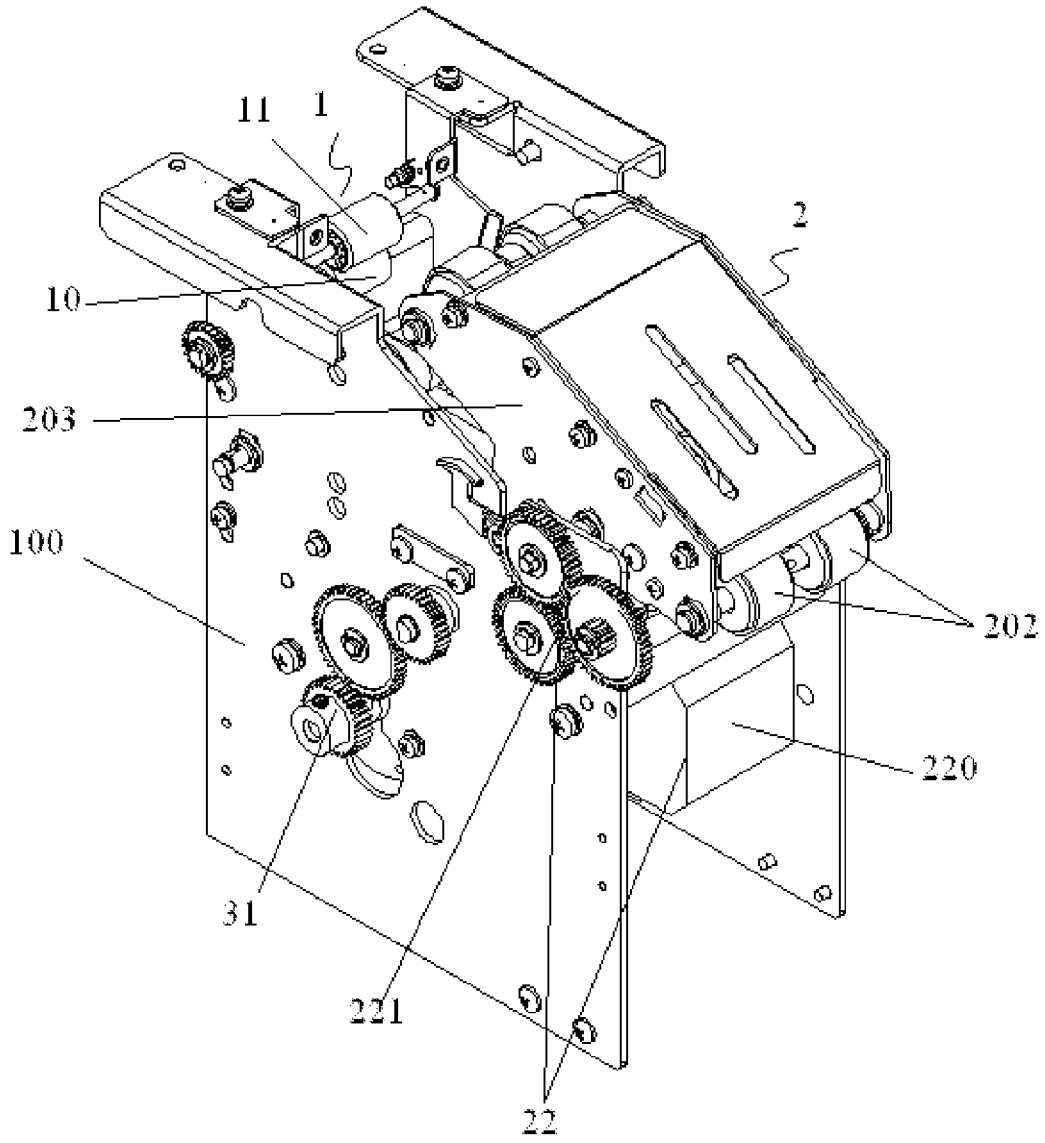
FIG. 1 is a perspective view of an embodiment of the device according to the present invention.
Figure 2:
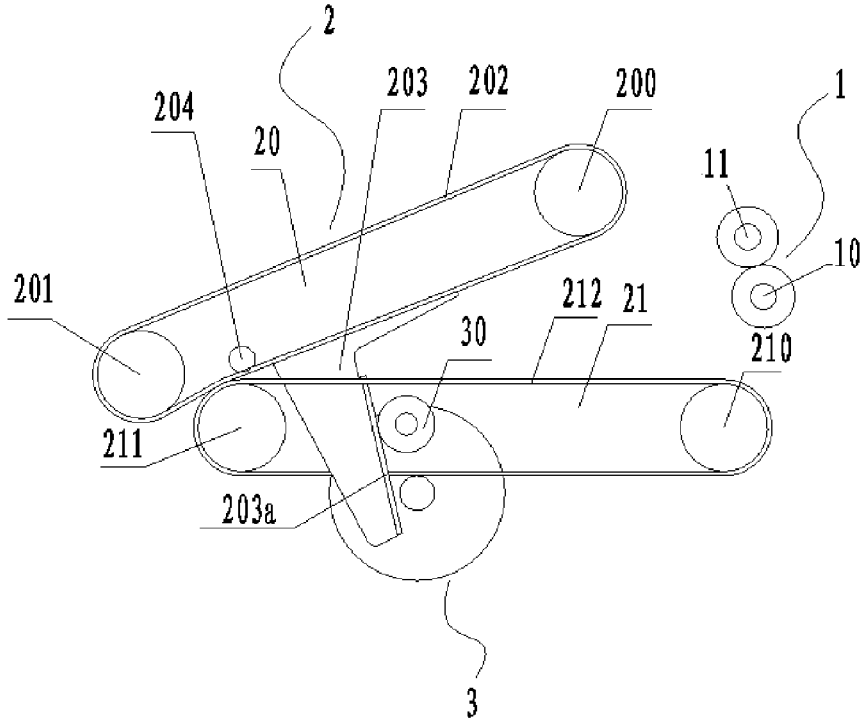
FIG. 2 is a structural schematic view of a first embodiment of the device according to the present invention.

As shown in FIG. 1 and FIG. 2, a sheet medium processing device comprises a feeding mechanism 1, a stacking mechanism 2 and a switching mechanism 3.

The feeding mechanism 1 comprises a driving feeding roller 10 and a driven feeding roller 11 for conveying sheet mediums.

In a sheet medium conveying direction, the stacking mechanism 2 is located downstream of the feeding mechanism 1 and comprises an upper channel 20, a lower channel 21 and a channel driving mechanism 22. The upper channel 20 comprises a first pulley 200, a second pulley 201, a first belt 202 and an upper channel support 203. The first pulley 200 and the second pulley 201 are supported by the upper channel support 203, and the first belt 202 is supported by the first pulley 200 and the second pulley 201. The lower channel 21 comprises a fifth pulley 210, a fourth pulley 211 and a second belt 212, the fifth pulley 210 and the fourth pulley 211 are supported by the housing 100 and the second belt 212 is supported by the fifth pulley 210 and fourth pulley 211. The end of the upper channel support 20 away from the feeding mechanism 1 is hinged with the housing 100 via a support rotating shaft 204 such that the upper channel 20 can be separated from or contacted with the lower channel 21. The channel driving mechanism 22 comprises a first motor 220 and a gear train 221 for driving the first belt 202 and the second belt 212 to move synchronously so as to convey the sheet mediums.

The switching mechanism 3 comprises a first cam 30 and a cam driving mechanism 31, and the first cam 30 is joined with the flange 203*a* of the upper channel support 203. The upper channel support 203 rotates around the rotating shaft 204 when the cam driving mechanism 31 drives the first cam 30 to rotate around the center thereof.

The operation process of the sheet medium processing device of the present invention will be described below with reference to FIG. 3 and FIG. 4. For the sake of a convenient description, the operation state of the device according to the present invention is divided into an initial state of stacking sheet mediums and a transporting state of transporting sheet mediums.

Figure 3:
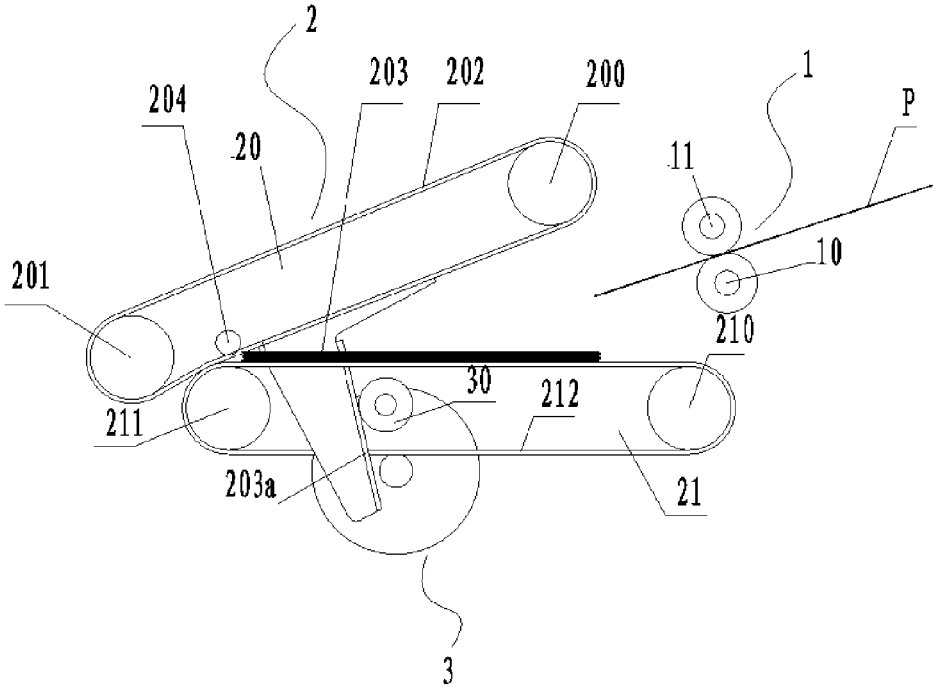
FIG. 3 is a structural schematic view illustrating the initial state of the first embodiment of the device according to the present application.

As shown in FIG. 3, when the device according to the present invention is in the initial state, the first cam 30 is located at a first predetermined position to limit the upper channel support 203 at a position at which the upper channel 20 is separated from the lower channel 21 such that a space can be formed between the upper channel and the lower channel to accommodate sheet mediums. Sheet mediums P are fed into the space between the upper channel 20 and the lower channel 21 one by one through the feeding mechanism 1. The sheet mediums P are stacked on the surface of the lower channel 21 due to the blocking at the contact location between the upper channel 20 and the lower channel 21, as the upper channel 20 is contacted with the lower channel 21 at the end away from the feeding mechanism 1.

Figure 4:
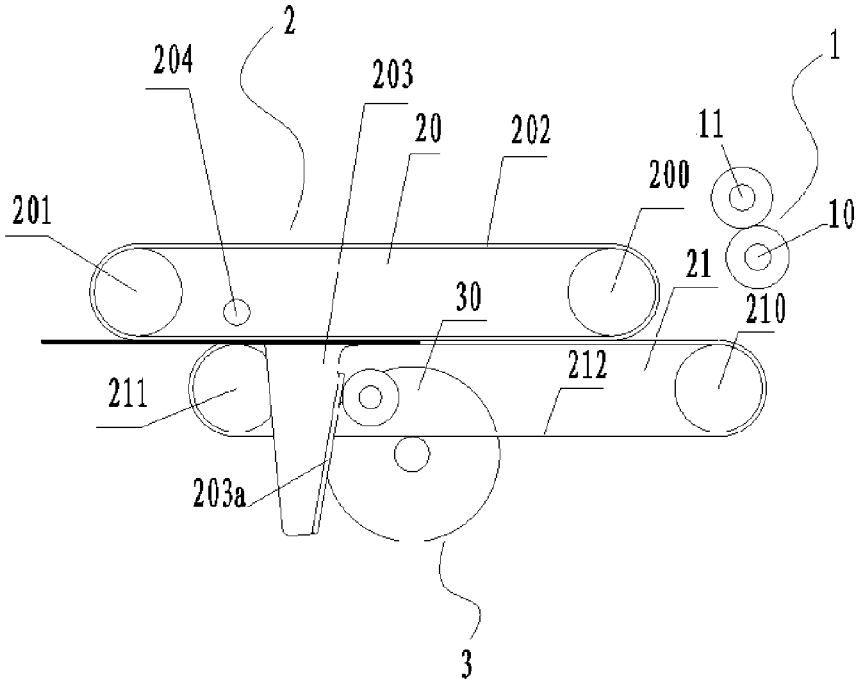
FIG. 4 is a structural schematic view illustrating the transporting state of the first embodiment of the device according to the present application.

As shown in FIG. 4, the sheet mediums temporarily stored on the surface of the lower channel 21 should be transported therefrom all at once after a certain number of sheet mediums are stacked. The first cam 30 rotates anticlockwise under the driving of the cam driving mechanism 31 and synchronously drives the upper channel support 203 to rotate clockwise around the rotating shaft 204. When the first cam rotates to a second predetermined position, the upper channel 20 is parallel to the lower channel 21, and the first belt 202 and the second belt 212 are tightly contacted with each other with a transporting path formed therebetween. As the stacked sheet mediums are located between the first belt and the second belt, such sheet mediums can be vertically trimmed and limited by means of the elasticity of the belts even if the sheet mediums are curved, thus guaranteeing a reliable conveying. Then, the first motor drives the first belt 202 and the second belt 212 to move synchronously so as to convey the stacked sheet mediums out from the device.

Embodiment 2

Figure 5:
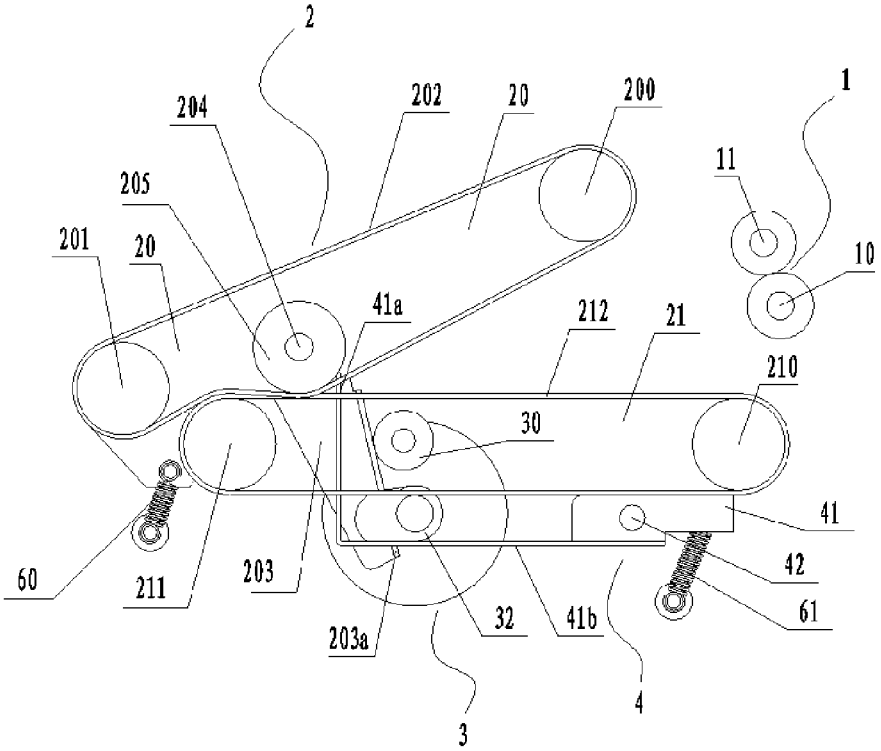
FIG. 5 is a structural schematic view of a second embodiment of the device according to the present invention.

As shown in FIG. 1 and FIG. 5, the sheet medium processing device comprises a feeding mechanism 1, a stacking mechanism 2, a switching mechanism 3 and an aligning mechanism 4. The housing 100 is omitted in the figures.

The feeding mechanism 1 comprises a driving feeding roller 10 and a driven feeding roller 11 for conveying a sheet medium.

The stacking mechanism 2 is located downstream of the feeding mechanism 1 and comprises an upper channel 20, a lower channel 21 and a channel driving mechanism 22. The upper channel 20 comprises a first pulley 200, a second pulley 201, a first belt 202, an upper channel support 203 and a third pulley 205. The first pulley 200 and the second pulley 201 are supported by the upper channel support 203, and the end of the upper channel support 203 away from the feeding mechanism 1 is hinged with the housing 100 via a support rotating shaft 204 such that the upper channel 20 can be separated from or contacted with the lower channel 21. The third pulley 205 is mounted over the outer surface of the support rotating shaft 204, and the first belt 202 is supported by the first pulley 200, the second pulley 201 and the third pulley 205. The lower channel 21 comprises a fifth pulley 210, a fourth pulley 211 and a second belt 212, the third pulley 210 and the fourth pulley 211 are supported by the housing 100, and the second belt 212 is supported by the fifth pulley 210 and the fourth pulley 211. The portion of the first belt 202 located at the third pulley 205 is throughout tightly contacted with the second pulley 212. A second elastic element 60 is at one end connected with the upper channel support 203 and at the other end connected with the housing 100. When being pulled by the second elastic element 60, the upper channel support 203 tends to rotate away from the lower channel 21. The channel driving mechanism 22 comprises a first motor 220 and a gear train 221 for driving the first belt 202 and the second belt 212 to move synchronously so as to convey the sheet mediums.

It should be noted that the third pulley 205 can be mounted over the support rotating shaft 204 or nearby thereto so as to guarantee the reliable contact between the first belt 202 and the second belt 212 at the end of the upper channel 20 hinged with the housing 100 so as to improve the conveying capability of the belts.

The switching mechanism 3 comprises a first cam 30 and a cam driving mechanism 31. The first cam 30 is joined with the flange 203*a* of the upper channel support 203. The upper channel support 203 rotates around the rotating shaft 204 when the cam driving mechanism 31 drives the first cam 30 to rotate around the center thereof.

The aligning mechanism 4 comprises a second cam 32, an aligning support plate 41 and a support plate rotating shaft 42. The aligning support plate 41 is bended at one end and is horizontal at the other end, thus forming L-shape. The bended end 41*a* of the aligning support plate 41 is close to the position where the upper channel 20 and the lower channel 21 are contacted with each other, that is, close to the third pulley mentioned in this embodiment. The horizontal end 41*b* of the aligning support plate 41 is close to the feeding mechanism 1 and hinged with the housing 100 via the support plate rotating shaft 42. A first elastic element 61 is at one end connected with the aligning support plate 41 and at the other end connected with the housing 100. When being pulled by the first elastic element 61, the aligning support plate 41 tends to rotate around the support plate rotating shaft 42 in a direction toward the lower channel 21 (the clockwise direction shown in FIG. 5). The second cam 32 is fixedly connected with the rotating shaft of the first cam 30 and rotates synchronously along with the first cam 30 under the driving of the cam driving mechanism 31. The second cam 32 is joined with the aligning support plate 41, and the second cam 32, when being driven by the cam driving mechanism 31 to rotate around the center thereof, drives the aligning support plate 41 to rotate around the support plate rotating shaft 42.

The operation process of the sheet medium processing device according to the present invention will be described below with reference to FIG. 6 and FIG. 7. For the sake of a convenient description, the operation state of the device of the present invention is divided into an initial state of stacking sheet mediums and a transporting state of transporting sheet mediums.

Figure 6:
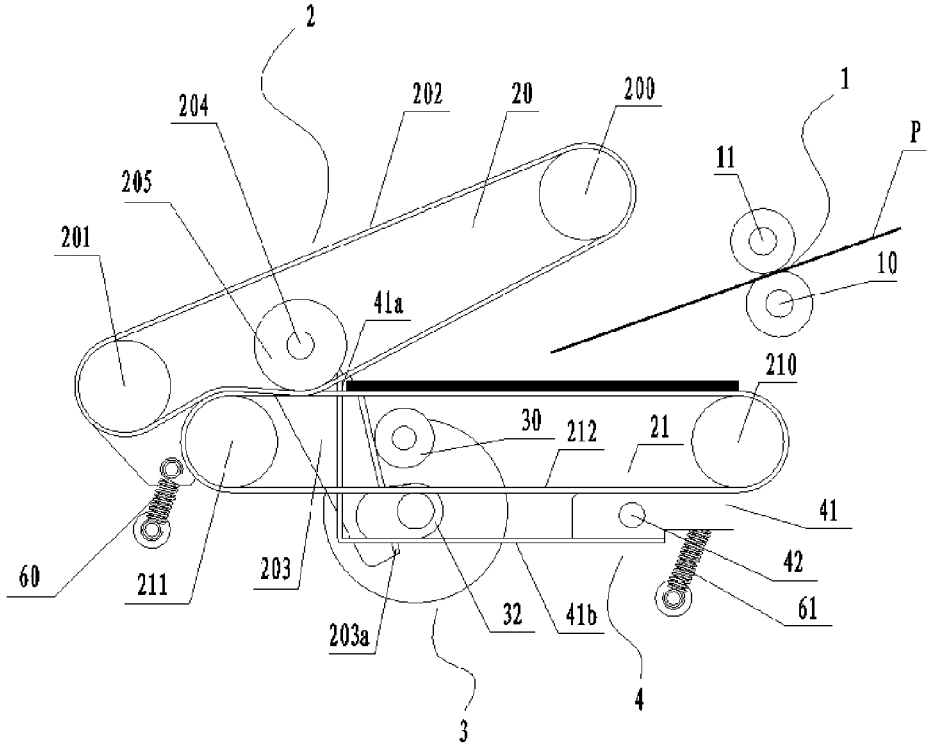
FIG. 6 is a structural schematic view illustrating the initial state of the second embodiment of the device according to the present application.

As shown in FIG. 6, when the device according to the present invention is in the initial state, the first cam 30 is located at a first predetermined position to limit the upper channel support 203 at a position at which the upper channel 20 is contacted with the lower channel 21 at the end away from the feeding mechanism 1 and separated from the lower channel 21 at the end close to the feeding mechanism 1 such that a space is formed between the upper and lower channels to accommodate sheet mediums. The upper channel support 203 tends to rotate in a direction away from the lower channel 21 (the anticlockwise direction shown in the figure) when being pulled by the second elastic element 60, thus the rotation of the upper channel support 203 in a direction towards the lower channel 21 (the clockwise direction shown in the figure) under the gravity can be prevented and the stability of the location of the upper channel support 203 is improved. Sheet mediums P are fed into the space between the upper channel 20 and lower channels 21 one by one through the feeding mechanism 1. A second cam 32 is located at a first preset location to limit the bended end 41*a* of the aligning support plate 41 at a position where the bended end 41*a* vertically passes through the lower channel 21. The sheet mediums P are stacked in alignment on the surface of the lower channel 21 due to the blocking of the bended end 41*a* of the aligning support plate 41.

Figure 7:
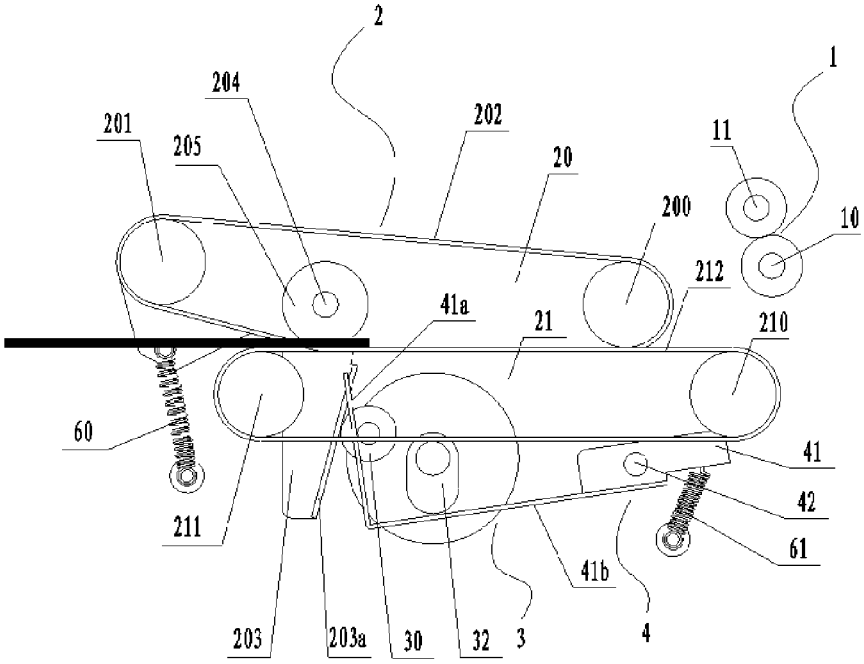
FIG. 7 is a structural schematic view illustrating the transporting state of the second embodiment of the device according to the present application.

As shown in FIG. 7, the sheet mediums temporarily stored on the surface of the lower channel 21 should be transported therefrom all at once after a certain number of sheet mediums are stacked. The first cam 30 and the second cam 32 rotate synchronously in a counter-clockwise direction under the driving of the cam driving mechanism 31 such that the first cam 30 drives the upper channel support 203 to rotate clockwise around the rotating shaft 204 and the second cam 32 drives the aligning support plate 41 to rotate anticlockwise around the support plate rotating shaft 42. When the first cam 30 rotates to a second predetermined position, the upper channel 20 is parallel to the lower channel 21, and the first belt 202 and the second belt 212 are tightly contacted with each other with a transporting path formed therebetween. When the second cam 32 rotates to a second preset location, the bended end 41*a* of the aligning support plate 41 is separated from the lower channel 21. The first motor drives the first belt 202 and the second belt 212 to move synchronously so as to convey the stacked sheet mediums out from the device.

Embodiment 3

Figure 8:
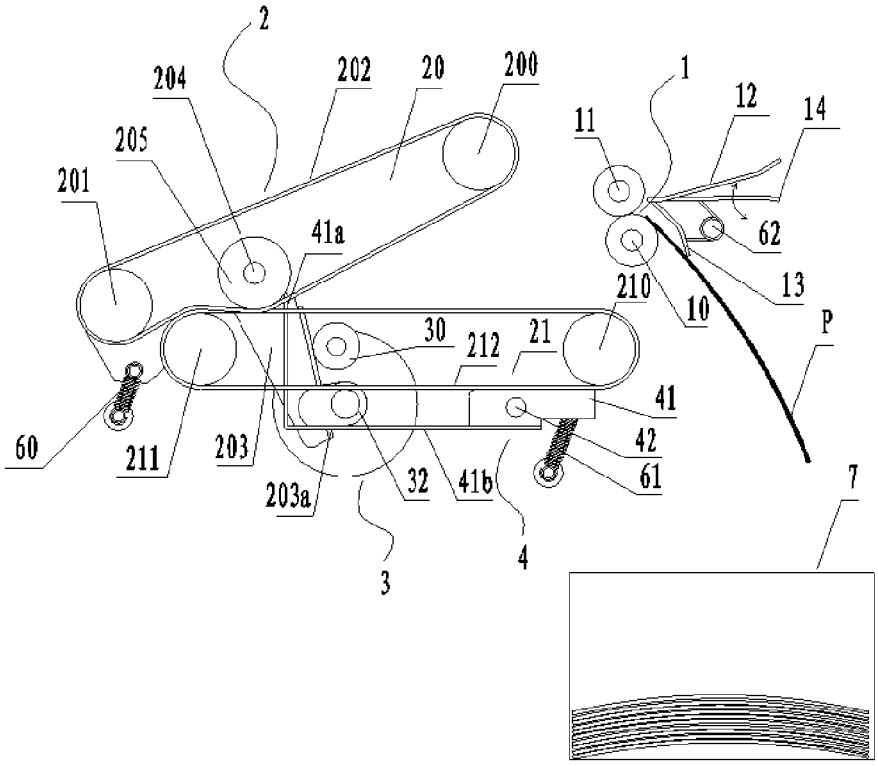
FIG. 8 is a structural schematic view illustrating the invalidated-tickets processing state of a third embodiment of the device according to the present application.
Figure 9:
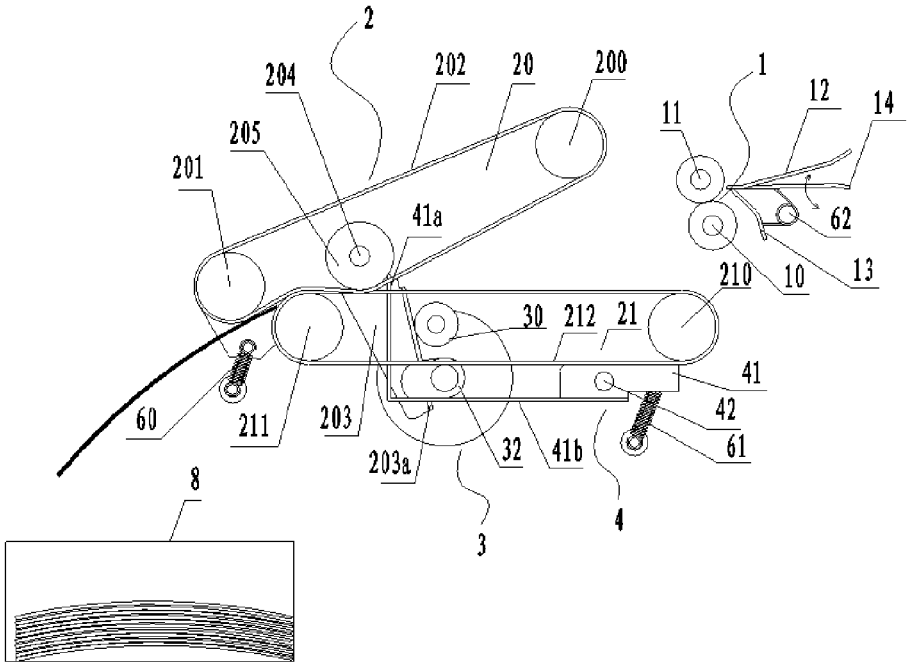
FIG. 9 is a schematic view illustrating the forgotten ticket withdrawing state of the third embodiment of the device according to the present application.

As shown in FIG. 8 and FIG. 9, this embodiment is different from the second embodiment in that an invalidated ticket box 7 is arranged between the feeding mechanism 1 and the stacking mechanism 2 and a withdrawing box 8 is arranged downstream of the stacking mechanism 2.

Additionally, the feeding mechanism 1 further comprises a first channel plate 12, a second channel plate 13 and a floating plate 14. The floating plate 14 is hinged with the housing 100 and located between the first channel plate 12 and the second channel plate 13. The floating plate 14 is contacted with the first channel plate 12 when being pulled by a third elastic element 62.

It should be noted that different transporting directions can be formed by contacting the upper channel with the lower channel or separating the upper channel from the lower channel. The reason for that is: when the upper channel is contacted with the lower channel, sheet mediums will be transported along the lower channel direction as the upper channel is parallel to the lower channel, and when the upper channel is separated from the lower channel, an angle is formed between the upper channel and the lower channel, and sheet mediums will be conveyed along the direction of the angle as the end of the upper channel 20 away from the feeding mechanism 1 is always contacted with the lower channel, that is, the end of the first belt 202 away from the feeding mechanism 1 is always contacted with the second belt 212.

The processing and withdrawing of invalidated tickets realized in this embodiment will be described below. When a sheet medium is inserted between the first channel plate 12 and the floating plate 14 along a sheet feeding direction, the floating plate 14, under the pushing force of the sheet mediums P, is separated from the first channel plate against the pulling force of the elastic element 62 such that the sheet medium is fed into the driving feeding roller 10 and the driven feeding roller 11 therebetween. When abnormality occurs to the sheet mediums P, the driving feeding roller 10 and the driven feeding roller 11 rotate in a direction opposite to the ticket feeding direction where the end of the medium is clamped, and the sheet medium P pass between the driving feeding roller 10 and the second channel plate 13 and then enter the invalidated ticket box.

When a plurality of sheet mediums are stacked in the stacking mechanism 2 (the stacking process is identical to that in the embodiments described above and thus more description is omitted here), the upper channel 20 rotates to be parallel to the lower channel 21, and the first belt 202 and the second belt 212 are tightly contacted with each other with a transporting path formed therebetween. The channel driving mechanism 22 drives the first belt 202 and the second belt 212 to move so as to convey the stacked sheet mediums out of the device along the direction of the lower channel.

If the sheet mediums are not taken away, the channel driving mechanism 22 drives the first belt 202 and the second belt 212 to move oppositely so as to withdraw the mediums into the device firstly. Then, the cam driving mechanism 31 drives the first cam 30 to rotate clockwise so as to enable the first cam 30 to return to the first predetermined location, and meanwhile the end of the upper channel 20 close to the feeding mechanism 1 is separated from the lower channel 21 and a certain angel is formed between the upper channel 20 and the lower channel 21, thus the sheet mediums are transported along the direction of the angle and fed into the withdrawing box.

Figure 10:
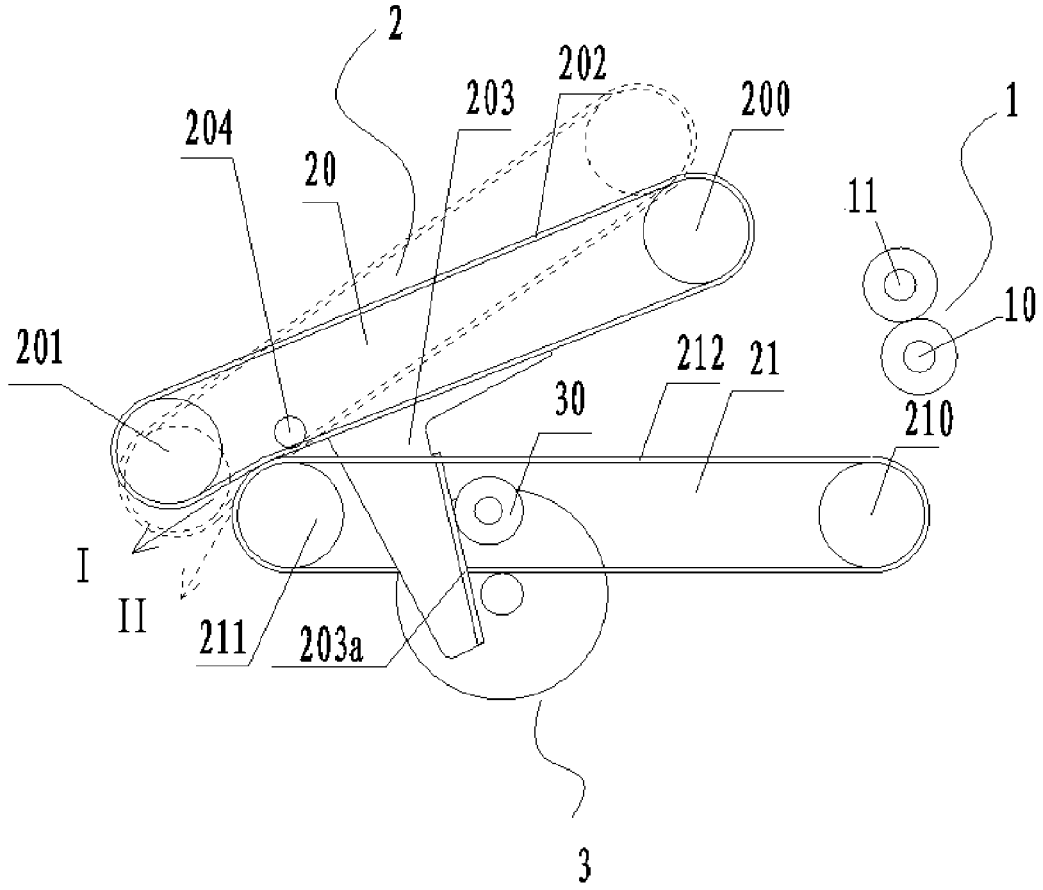
FIG. 10 is a structural schematic diagram illustrating the operation state of an embodiment of the device according to the present application.

It should be noted that the angle formed between the upper channel 20 and the lower channel 21 can be adjusted according to the location of the first cam 30. As shown in FIG. 10, when the first cam 30 is located at the first predetermined location, a first angle is formed between the upper channel 20 and the lower channel 21 at the contact portion and the mediums are transported along the direction of arrow I, and when the first cam 30 is located at the third preset location, a second angle is formed between the upper channel 20 and the lower channel 21 at the contact portion and the mediums are transported along the direction of arrow II. Different transporting directions can be formed by adjusting the location relationship between the upper channel and the lower channel so as to transport the sheet mediums to different destinations according to the specific requirements.

The embodiments according to the present application described above are not intended to limit the protection scope of the present invention. Any modifications, equivalents and improvements should be included in the protection scope of the present invention without departing from the spirit and principle of the present invention.

The invention claimed is:

1. A sheet mediums processing device comprising a housing and a feeding mechanism mounted on the housing, wherein the feeding mechanism comprises a driving feeding roller and a driven feeding roller, and wherein the device further comprises:

a stacking mechanism, which is located downstream of the feeding mechanism and comprises an upper channel, a lower channel and a channel driving mechanism, wherein the lower channel is fixedly connected with the housing, and the upper channel is hinged with the housing with one end thereof separatable from or contactable with the lower channel, and the channel driving mechanism is connected with the upper channel and the lower channel to drive the upper channel and the lower channel to move synchronously so as to transport sheet mediums;

a switching mechanism comprising a first cam and a cam driving mechanism, wherein the first cam is joined with the upper channel for driving the upper channel to rotate; and an aligning mechanism, wherein the aligning mechanism comprises an aligning support plate, a second cam, and a first elastic element, and wherein the aligning support plate is hinged with the housing, the second cam is fixedly connected with the rotating shaft of the first cam and joined with the aligning support plate, and the first elastic element is at one end connected with the aligning support plate and at the other end connected with the housing.

2. The device according to claim 1, wherein the upper channel comprises an upper channel support, a first pulley set, a first belt and a support rotating shaft, wherein the first pulley set is supported by the upper channel support, the first belt is supported by the first pulley set, and the upper channel support is hinged with the housing via the support rotating shaft;

the lower channel comprises a second pulley set supported by the housing and a second belt supported by the second pulley set; and one end of the first belt can be separated from or contacted with the second belt when the upper channel support rotates around the support rotating shaft.

3. The device according to claim 2, wherein the end of the first belt away from the feeding mechanism is always contacted with the second belt.

4. The device according to claim 2, wherein the first pulley set comprises a first pulley, a second pulley and a third pulley, and the third pulley is located between the first pulley and the second pulley to support the first belt to be always contacted with the second belt.

5. The device according to claim 4, wherein the third pulley is mounted over the support rotating shaft.

6. The device according to claim 1, wherein the upper channel further comprises a second elastic element, and the second elastic element is at one end connected with the housing and at the other end connected with the upper channel support.

7. The device according to claim 6, wherein the feeding mechanism further comprises:

a first channel plate, a second channel plate, a floating plate and a third elastic element, wherein the floating plate is hinged with the housing and located between the first channel plate and the second channel plate; and the third elastic element is at one end connected with the housing and at the other end connected with the floating plate, and the floating plate is contacted with the first channel plate when being pulled by the third elastic element.

8. The device according to claim 7, wherein an invalidated ticket box is arranged between the feeding mechanism and the stacking mechanism.

9. The device according to claim 1, wherein a withdrawing box is arranged downstream of the stacking mechanism.

* * * * *